US007425921B2

(12) United States Patent
Milyakh

(10) Patent No.: US 7,425,921 B2
(45) Date of Patent: Sep. 16, 2008

(54) BROADBAND ANTENNA SYSTEM

(75) Inventor: Yaroslav Milyakh, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 49 days.

(21) Appl. No.: 11/319,426

(22) Filed: Dec. 29, 2005

(65) Prior Publication Data

US 2006/0279463 A1 Dec. 14, 2006

(30) Foreign Application Priority Data

Jun. 13, 2005 (JP) ..... 10-2005-0050516

(51) Int. Cl.
*H01Q 1/38* (2006.01)
*H01Q 9/00* (2006.01)

(52) U.S. Cl. ..... 343/700 MS; 343/752

(58) Field of Classification Search ..... 343/700 MS, 343/749, 752, 751
See application file for complete search history.

(56) References Cited

U.S. PATENT DOCUMENTS

| | | | | |
|---|---|---|---|---|
| 3,967,276 | A | 6/1976 | Goubau | |
| 6,906,677 | B2 * | 6/2005 | Yamamoto et al. | 343/789 |
| 2002/0149527 | A1 | 10/2002 | Wen et al. | |
| 2004/0066338 | A1 * | 4/2004 | Chen et al. | 343/700 MS |

FOREIGN PATENT DOCUMENTS

| | | | |
|---|---|---|---|
| EP | 1441415 | A1 | 7/2004 |
| JP | 08-250916 | A | 9/1996 |
| JP | 09-055620 | A | 2/1997 |
| JP | 2003-188633 | A | 7/2003 |
| JP | 2004-023637 | A | 1/2004 |
| WO | WO 03/075404 | A1 | 9/2003 |

OTHER PUBLICATIONS

S. Lim, et al.: "Electrically small antenna for maximizing transmission into HF ground waves" Electronics Letters, IEE STEVENAGE, GB, vol. 40, No. 22, Oct. 28, 2004, pp. 1388-1389, ISSN: 0013-5194.

* cited by examiner

*Primary Examiner*—Douglas W. Owens
*Assistant Examiner*—Robert Karacsony
(74) *Attorney, Agent, or Firm*—Sughrue Mion, PLLC

(57) ABSTRACT

A broadband antenna system includes a ground plane, a metal plate parallel to the ground plane, and constituting a capacitance load against the ground plane, and a radiation structure connected perpendicularly to the ground plane and the metal plate. The radiation structure includes a feed conductor to supply an electric signal, a short-circuit stub to transfer the supplied electric signal to the ground plane, a conducting bridge to interconnect the feed conductor and the short-circuit stub, which is separated from the metal plate, and a radiating conductor connected to the ground plane the metal plate, and coupled to the supplied electric signal to thereby radiate electromagnetic waves.

7 Claims, 11 Drawing Sheets

BROADBAND ANTENNA SYSTEM

CROSS-REFERENCE TO RELATED APPLICATION

This application claims priority from Korean Patent Application No. 10-2005-0050516 filed on Jun. 13, 2005 in the Korean Intellectual Property Office, the disclosure of which is incorporated herein by reference in its entirety.

BACKGROUND OF THE INVENTION

1. Field of the Invention

Systems consistent with the present invention are directed to broadband antennas. More particularly, the present invention relates to a small-sized broadband antenna system having an integrated matching circuit.

2. Description of the Related Art

FIG. 1 illustrates a structure of a conventional quarter-wavelength monopole antenna system. Referring to FIG. 1, an antenna system 100 consists of an antenna positioned perpendicularly to a ground plane 110.

In the antenna system 100, a radiation pattern is formed between the antenna 120 and the ground plane 110 by connecting a lower end of the antenna 120 to a power source 130 that supplies signals.

An upper end of the antenna 120 may be terminated by a metal plate 140, which acts as a capacitance load against the ground plane 110 in order to shorten the height of the antenna 120. The height of the antenna 120 may be shortened by the metal plate 140, but this is not sufficient to meet the need for wireless products to be small and compact.

SUMMARY OF THE INVENTION

The present invention provides a broadband antenna system capable of reducing the size of an antenna system and obtaining a broad bandwidth, without adversely affecting the antenna gain and radiation characteristics.

According to an exemplary aspect of the present invention, there is provided a broadband antenna system comprising a ground plane, a metal plate parallel to the ground plane, and constituting a capacitance load against the ground plane, and a radiation structure connected perpendicularly to the ground plane and the metal plate, wherein the radiation structure includes a feed conductor to supply an electric signal, a short-circuit stub to transfer the supplied electric signal to the ground plane, a first plane comprising a conducting bridge to interconnect the feed conductor and the short-circuit stub, which is separated from the metal plate, and a second plane comprising a radiating conductor connected to the ground plane the metal plate, and coupled to a signal supplying structure to thereby radiate electromagnetic waves.

According to another exemplary aspect of the present invention, there is provided a broadband antenna system comprising a ground plane, a metal plate parallel to the ground plane, and constituting a capacitance load against the ground plane, a radiation structure to interconnect the ground plane and the metal plate, wherein the radiation structure includes a feed conductor to supply an electric signal, a short circuit stub to transfer the supplied electric signal to the ground plane, a connecting bridge to interconnect the feed conductor and the short-circuit stub, which is separated from the metal plate, and a radiating conductor connected perpendicularly to the metal plate and the ground plane and coupled to the supplied electric signal, to thereby radiate electromagnetic waves.

According to a further exemplary aspect of the present invention, there is provided a broadband antenna system comprising a pair of feed wires, a pair of metal plates parallel to oppositely faced feed wires, and between which the feed wires are positioned, and a radiation structure to interconnect the feed wires and the metal plates, wherein the radiation structure includes a feed conductor separated from the metal plates, into which an electric signal is input through the feed wires on one side thereof, and a radiating conductor connected perpendicularly to the metal plate on the other side thereof and coupled to the electric signal to thereby radiate electromagnetic waves.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF EXEMPLARY EMBODIMENTS OF THE INVENTION

The present invention will now be described more fully with reference to the accompanying drawings in which exemplary embodiments of the invention are shown. Advantages and features of the present invention and methods of accomplishing the same may be understood more readily by reference to the following detailed description of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the invention to those skilled in the art, and the present invention will only be defined by the appended claims.

Figure 1:
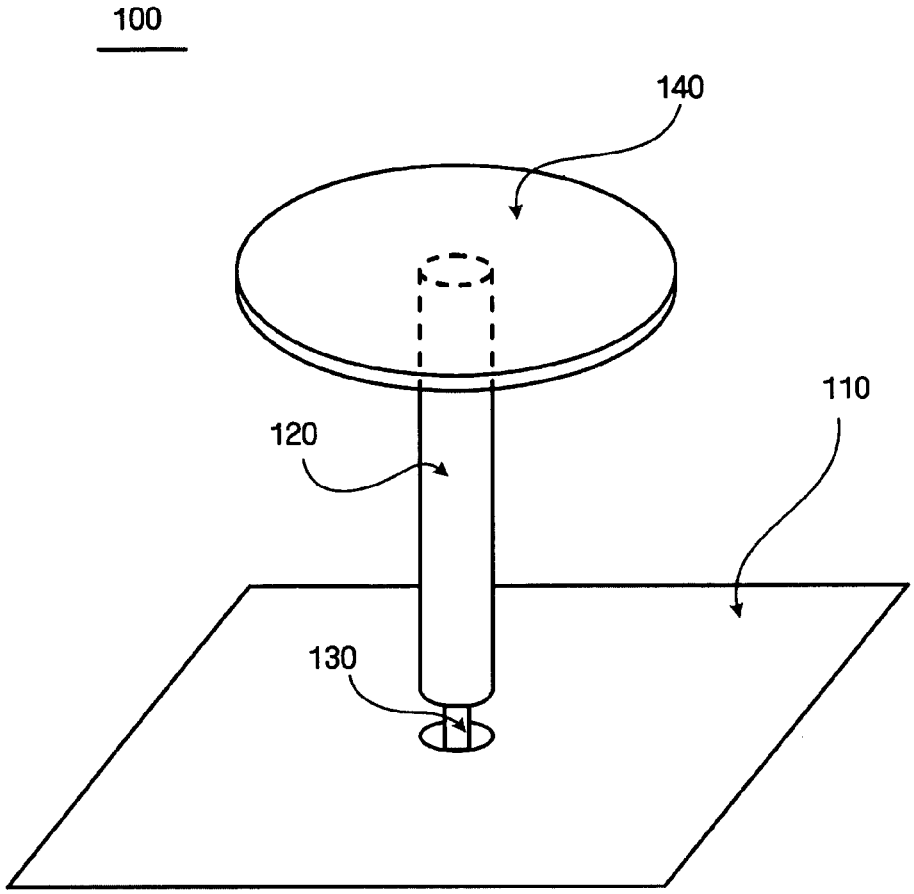
FIG. 1 illustrates a structure of a conventional quarter-wavelength monopole antenna system.
Figure 2:
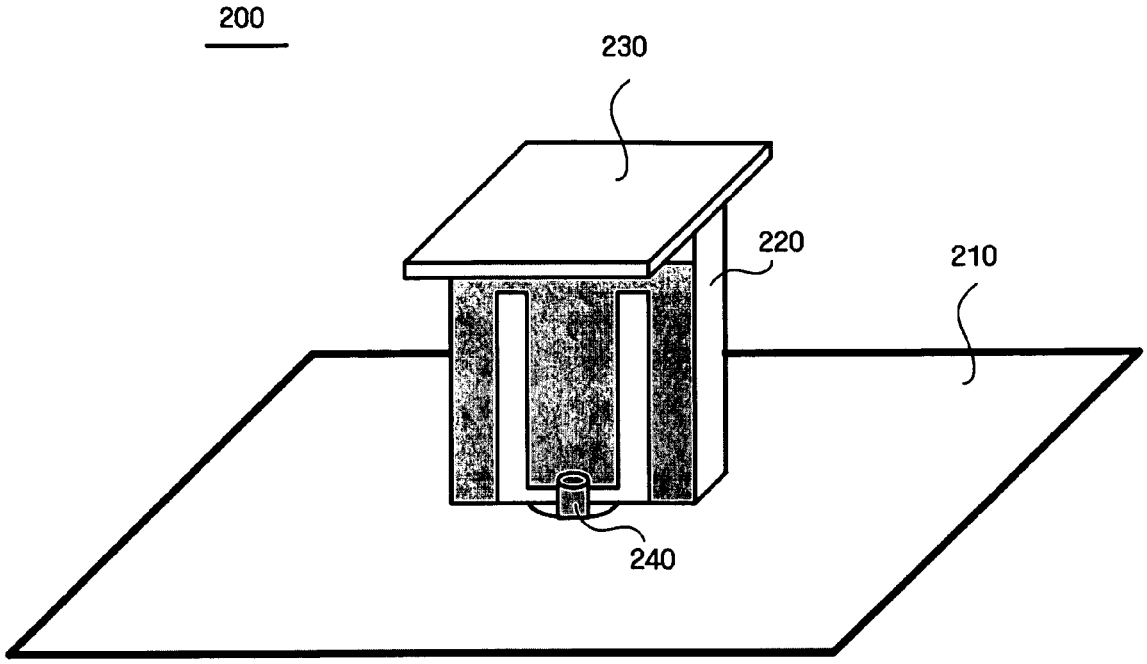
FIG. 2 illustrates a construction of a broadband antenna system according to an exemplary embodiment of the present invention.

FIG. 2 illustrates a construction of a broadband antenna system according to an exemplary embodiment of the present invention. Referring to this figure, the broadband antenna system 200 comprises a ground plane 210, a metal plate 230, a radiation structure 220, and a power source 240. The power source 240 supplies signals to be transferred to the radiation structure 220.

As depicted in FIG. 2, the radiation structure 220 may be shaped like a rectangular parallelepiped. A conductor line along which signals are transferred may be formed the surfaces of opposite planes of the radiation structure 220. Further, both ends of the radiation structure 220 are connected perpendicularly to the ground plane 210 and the metal plate 230 respectively.

The metal plate 230 is parallel to the ground plane 210, which acts as a capacitance load against the ground plane 210. Accordingly, since the broadband antenna system 200 may be represented as an equivalent circuit having a transmission conductor line that is shorter than a quarter-wavelength, the size of the broadband antenna system 200 may be reduced.

Figure 3A:
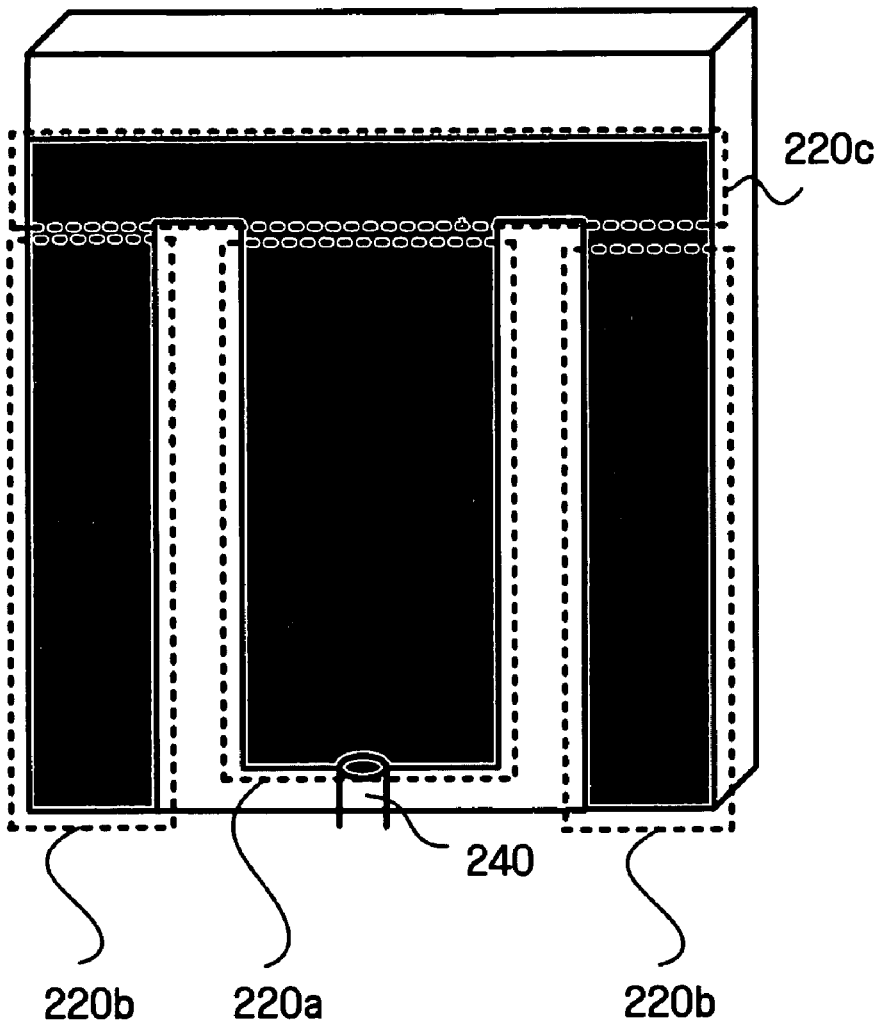
FIGS. 3A and 3B illustrate a front and a rear of a radiation structure of the broadband antenna system illustrated in FIG. 2.
Figure 3B:
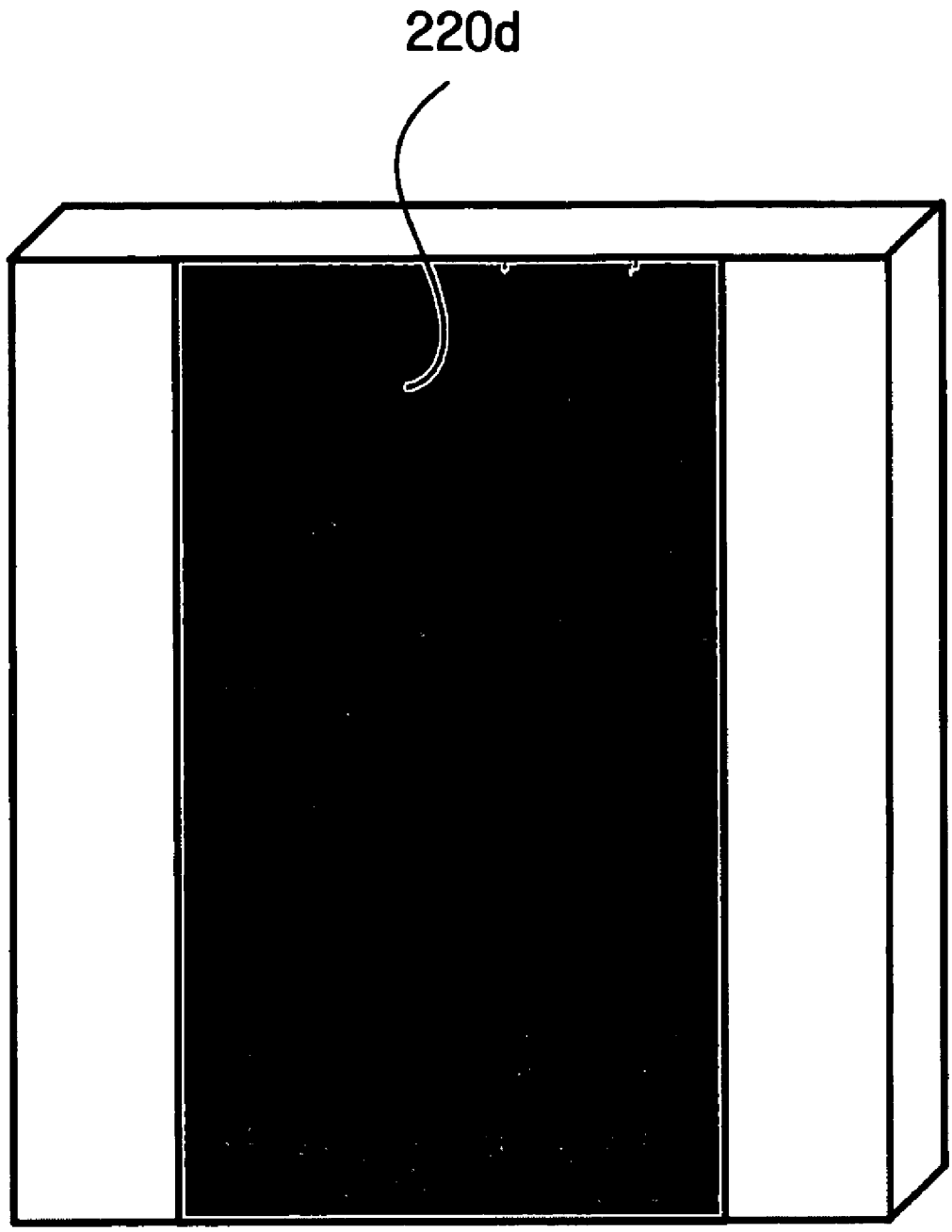

Among the planes constituting the radiation structure 220, a construction of the plane on which the conductor line is formed is illustrated in FIGS. 3A and 3B. FIG. 3A shows a front view of the radiation structure 220, and FIG. 3B shows a rear view of the radiation structure 220.

Referring to FIG. 3A, a feed conductor 220*a*, a short-circuit stub 220*b*, and a conducting bridge 220*c* are formed on the front side of the radiation structure 220. Referring to FIG. 3B, a radiation conductor 220*d* is formed on the rear side thereof.

One end of the short-circuit stub 220*b* is connected to the ground plane 210 shown in FIG. 2, and the other end is connected to the conducting bridge 220*c*.

The conducting bridge 220*c* is separated from the metal plate 230 shown in FIG. 2, and one end of the radiating conductor 220*d* is connected to the ground plane 210, and the other end is connected to the metal plate 230.

When a signal is input from the power source 240, it is fed to the feed conductor 220*a*.

At this time, electromagnetic waves are generated in the radiating conductor 220*d* as the input signal is coupled to the radiating conductor 220*d*, whereby the input signal is transmitted into a free space.

In addition, the signal fed to the feed conductor 220*a* is transmitted to the short-circuit stub 220*b* through the conducting bridge 220*c*, and is then transmitted to the ground plane 210.

Figure 4A:
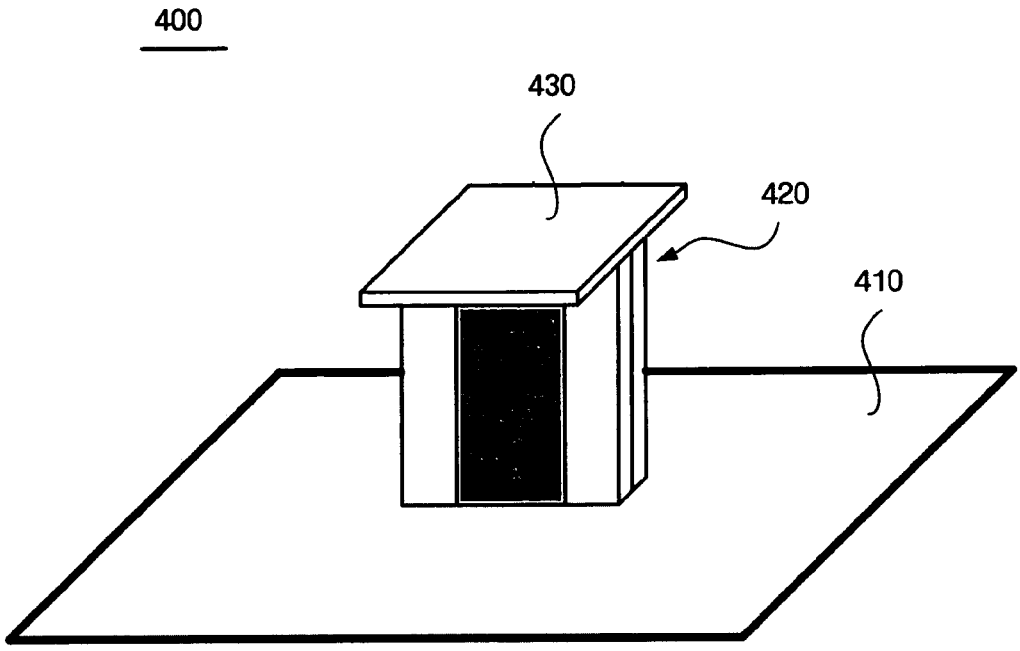
FIGS. 4A and 4B illustrate a construction of a broadband antenna system according to another exemplary embodiment of the present invention.
Figure 4B:
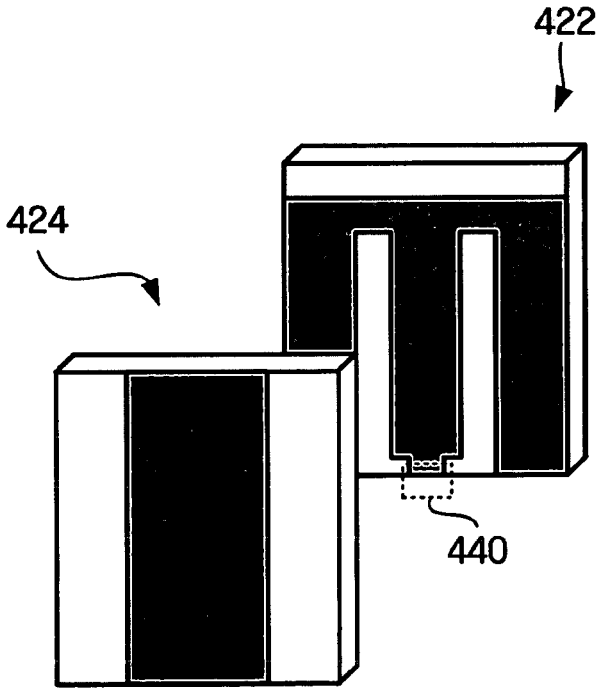

FIGS. 4A and 4B illustrate a construction of a broadband antenna system according to another exemplary embodiment of the present invention.

The broadband antenna system 400 illustrated in FIG. 4A comprises a ground plane 410, a radiation structure 420 and a metal plate 430, which is similar in shape to the broadband antenna system depicted in FIG. 2. However, the broadband antenna system 400 depicted in FIG. 4A is constructed with three planes or layers (i.e., a front layer, a middle layer and a rear layer), on which the conductors are disposed.

The broadband antenna system 200 of FIG. 2 has two planes, on which the conductors are disposed, i.e., a first plane into which an electric signal is input, and a second plane from which electromagnetic waves radiate. In the broadband antenna system 400 depicted in FIG. 4A, an electric signal is input into the middle layer, and electromagnetic waves radiate from both the front layer and the rear layer.

The radiation structure 420 includes two rectangular parallelepipeds 422 and 424 which are constructed as shown in FIGS. 3A and 3B. The rectangular parallelepipeds 422 and 424 are oppositely coupled so that conductors, into which signals are input from the power source 440, are disposed on opposite faces of the middle layer, and radiating conductors are disposed on the other faces, i.e., the front layer and the rear layer.

Figure 5A:
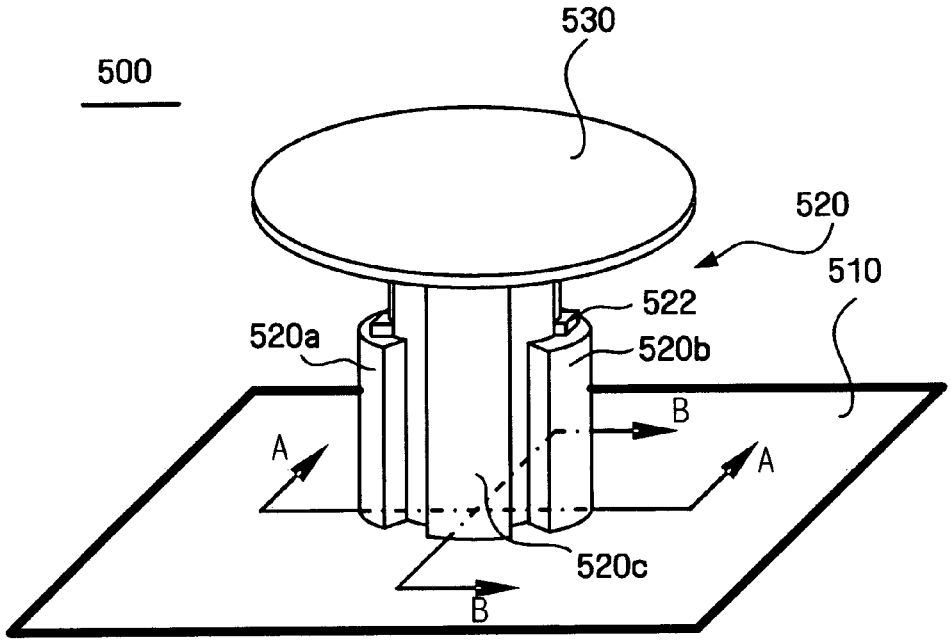
FIGS. 5A to 5D illustrate a construction of a broadband antenna system according to another exemplary embodiment of the present invention.
Figure 5B:
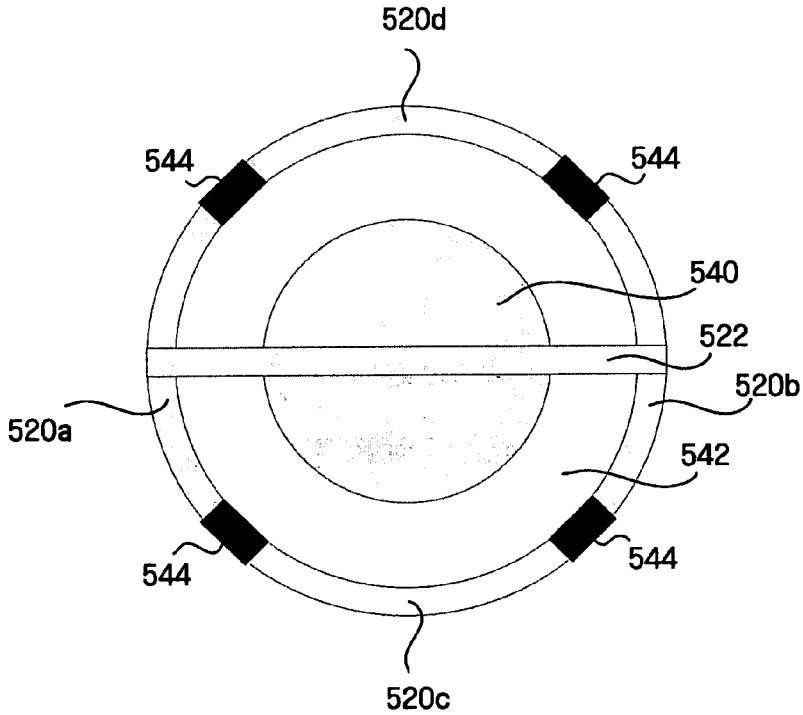

FIGS. 5A and 5B also illustrate a construction of a broadband antenna system according to another exemplary embodiment of the present invention.

The broadband antenna system 500 depicted in FIG. 5A comprises a ground plane 510, a metal plate 530 parallel to the ground plane 510 and acting as a capacitance load against the ground plane 510, and a radiation structure 520 to interconnect the ground plane 510 and the metal plate 530.

The radiation structure 520 comprises a feed conductor 540 to provide an electric signal, two short-circuit stubs 520*a* and 520*b* to transfer the provided electric signal to the ground plane 510, a conducting bridge 522 to interconnect the feed conductor 540 and the short-circuit stubs 520*a* and 520*b*, which is separated from the metal plate 530, and two radiating conductors 520*c* and 520*d* connected perpendicularly to the metal plate 530 and the ground plane 510, and coupled to the provided electric signal to thereby radiate electromagnetic waves.

The broadband antenna system 500 of FIG. 5A comprises two short-circuit stubs 520*a* and 520*b*, and two radiating conductors 520*c* and 520*d*.

FIG. 5B is a top plan view of the radiation structure 520, which corresponds to a planar structure of a coaxial cable.

An internal conductor of the coaxial cable, to which a signal is transferred, corresponds to the feed conductor 540, and an external conductor thereof corresponds to two short-circuit stubs 520*a* and 520*b*, and two radiating conductors 520*c* and 520*d*. The short-circuit stubs 520*a* and 520*b* can be distinguished from the radiating conductors 520*c* and 520*d* by truncating a part of the external conductor of the coaxial cable. The truncated part is indicated by the reference numeral 544 in FIG. 5B.

In addition, the two short-circuit stubs 520*a* and 520*b*, and the two radiating conductors 520*c* and 520*d* are opposite one another, relative to the feed conductor 540.

Figure 5C:
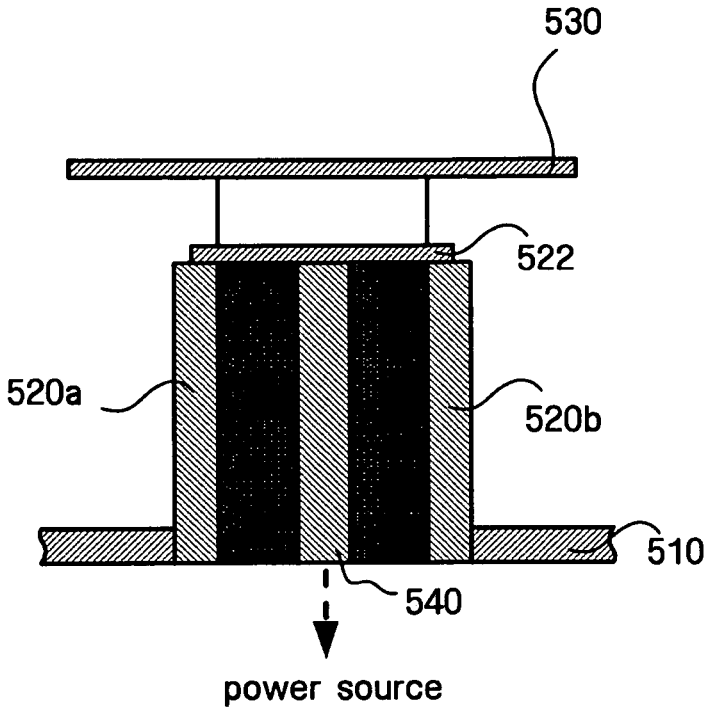
Figure 5D:
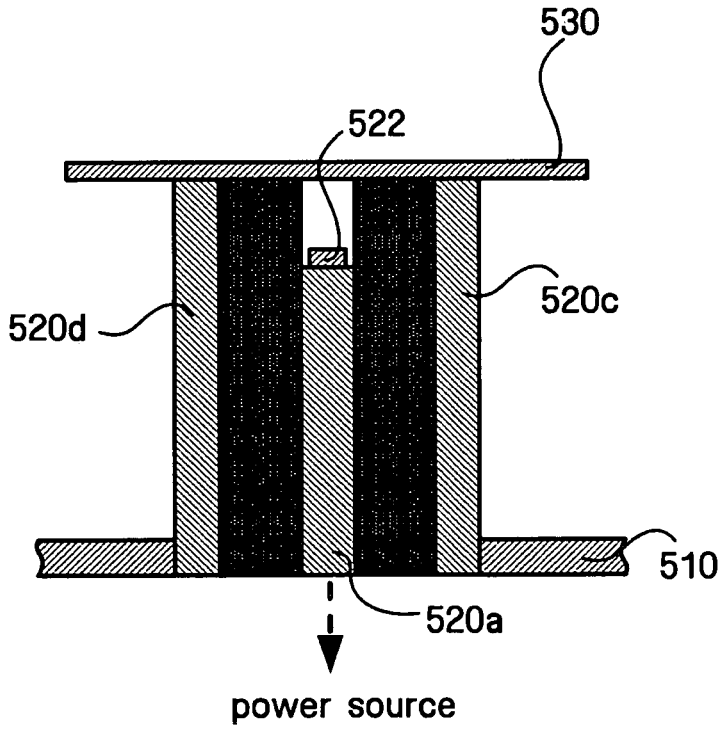

FIG. 5C shows the structure of the radiation structure 520 when viewed in the "A" direction of FIG. 5A, and FIG. 5D shows the structure of the radiation structure 520 when viewed in the "B" direction of FIG. 5A.

Figure 6:
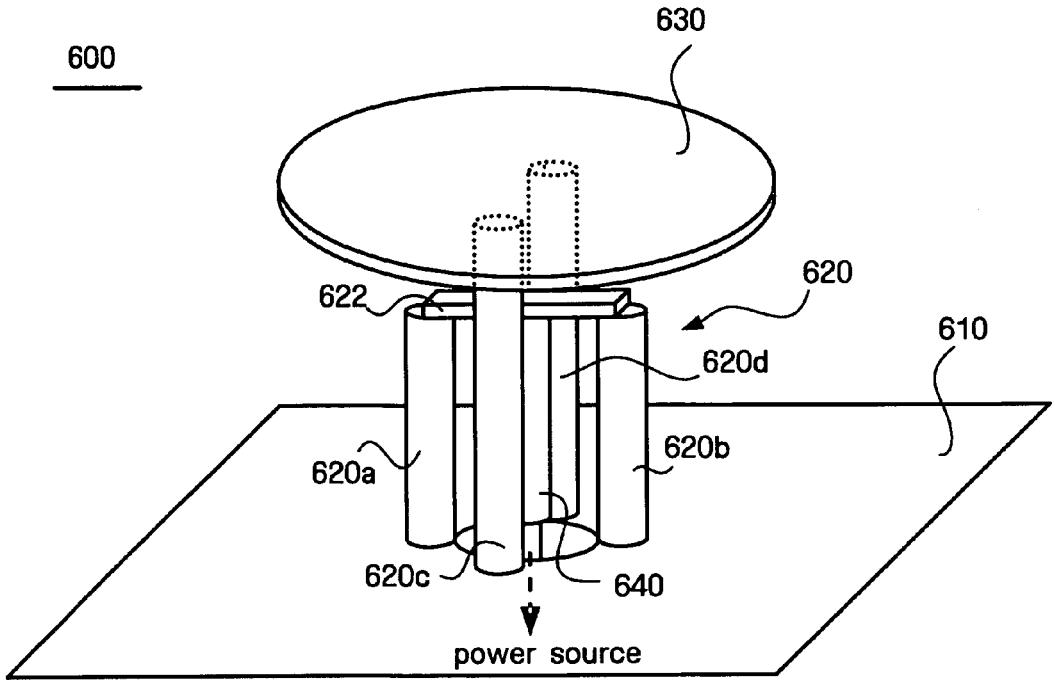
FIG. 6 illustrates a construction of a broadband antenna system according to another exemplary embodiment of the present invention.

FIG. 6 illustrates a broadband antenna system 600 similar in shape to the broadband antenna system 500 depicted in FIG. 5A.

That is, the broadband antenna system 600 comprises a ground plane 610, a metal plate 630 parallel to the ground plane 610 and acting as a capacitance load against the ground plane 610, and a radiation structure 620 to interconnect the ground plane 610 and the metal plate 630.

The radiation structure 620 comprises a feed conductor 640 to provide an electric signal, short-circuit stubs 620*a* and 620*b* to transfer the provided electric signal to the ground plane 610, a conducting bridge 622 to interconnect the feed conductor 640 and the short-circuit stubs 620*a* and 620*b*, which is separated from the metal plate 630, and radiating conductors 620*c* and 620*d* connected perpendicularly to the metal plate 630 and the ground plane 610, and coupled to the provided electric signal to thereby radiate electromagnetic waves.

Like the broadband antenna system 500 of FIG. 5A, the broadband antenna system 600 of FIG. 6 comprises two short-circuit stubs 620*a* and 620*b*, and two radiating conductors 620*c* and 620*d*, which are opposite one another, relative to the feed conductor 640.

In the broadband antenna system 600 illustrated in FIG. 6, the feed conductor 640, the short-circuit stubs 620*a* and 620*b*, and the radiating conductors 620*c* and 620*d* may be formed of wire conductors.

Figure 7A:
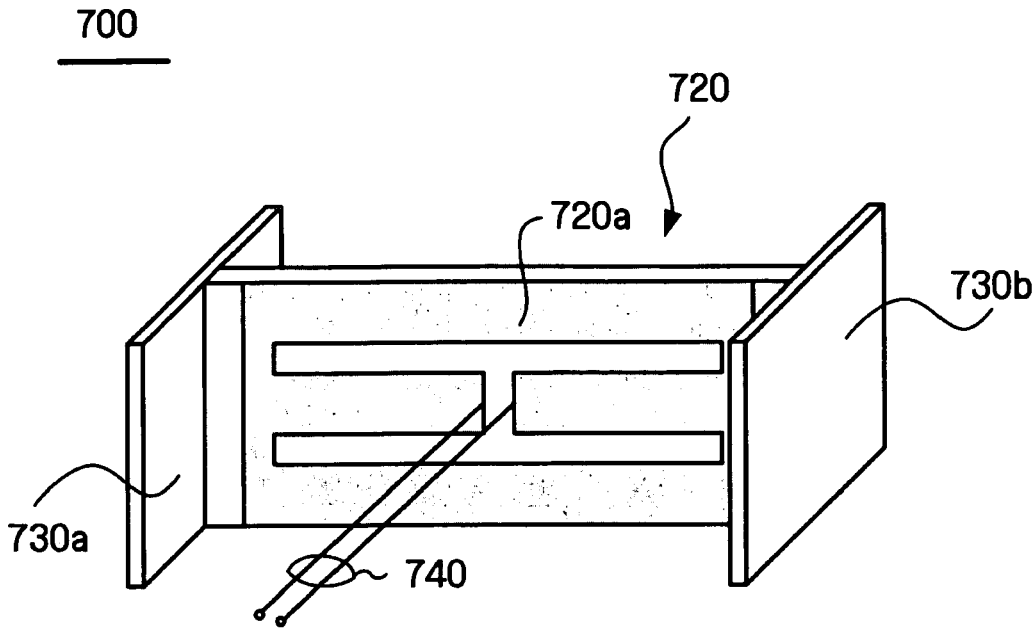
FIGS. 7A and 7B illustrate a construction of a broadband antenna system according to another exemplary embodiment of the present invention.
Figure 7B:
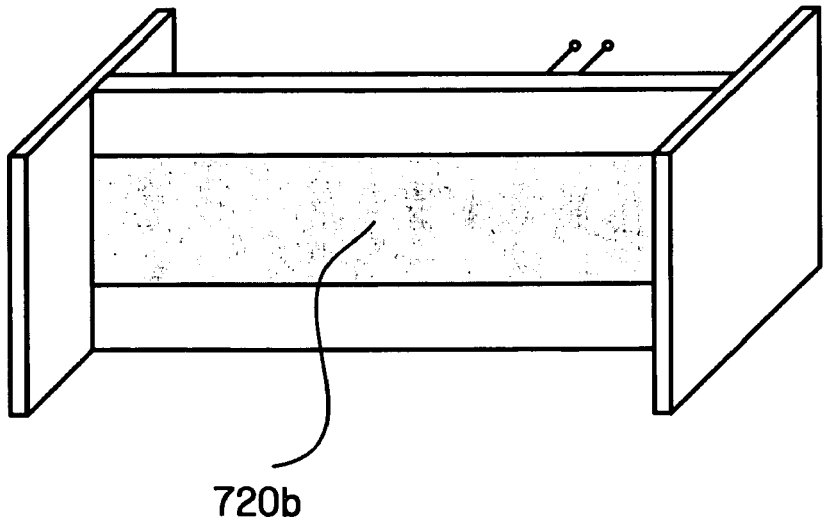

FIGS. 7A and 7B illustrate a construction of a broadband antenna system according to a still further exemplary embodiment of the present invention. The broadband antenna system 700 comprises a pair of feed wires 740, metal plates 730*a* and 730*b* parallel to the feed wires 740 (oppositely faced), and between which the feed wires 740 are disposed, and a radiation structure 720 to interconnect the feed wires 740 and the metal plates 730*a* and 730*b*.

On one side of the radiation structure 720 is formed the feed conductor 720*a* which can receive an input electric signal transmitted from the feed wire 740 since stubs are formed thereon. Since the feed wires 740 have positive (+) and negative (−) poles, the broadband antenna system 700 depicted in FIG. 7A can operate as a dipole antenna. Further, the feed conductor 720*a* is separated from the metal plates 730*a* and 730*b*.

On the opposite face to a plane on which the feed conductor 720*a* is formed is formed a radiating conductor 720*b* connected perpendicularly to the metal plates 730*a* and 730*b* and coupled to the provided electric signal, to thereby generate electromagnetic waves.

In FIGS. 7A and 7B, the feed wires 740 are connected perpendicularly to the feed conductor 720*b*.

Figure 8A:
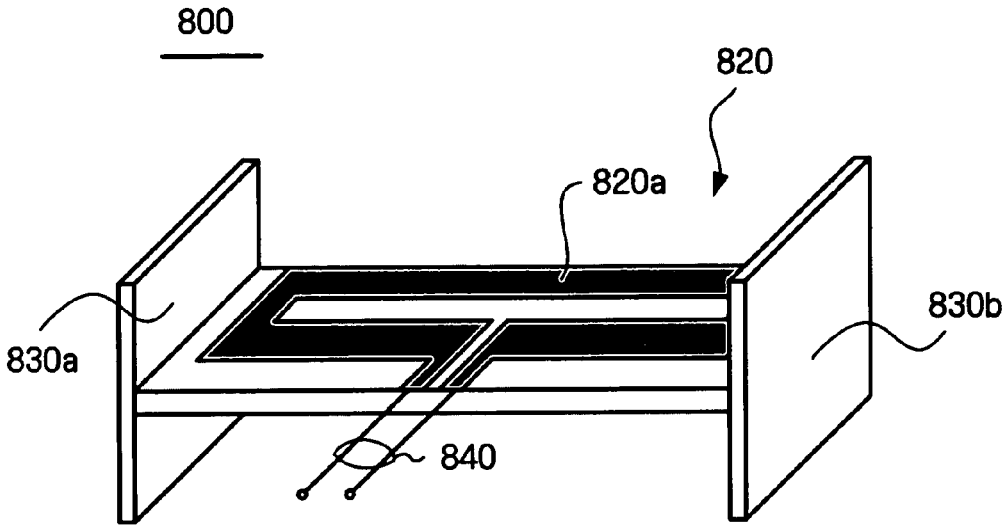
FIGS. 8A and 8B illustrate a construction of a broadband antenna system according to another exemplary embodiment of the present invention.
Figure 8B:
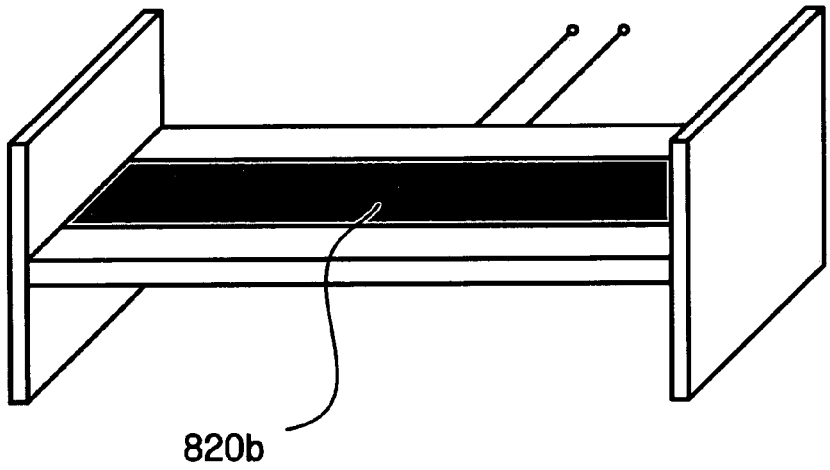

FIGS. 8A and 8B illustrate a construction of a broadband antenna system according to a still further exemplary embodiment of the present invention, which is similar to that of the broadband antenna system depicted in FIGS. 7A and 7B.

This broadband antenna system 800 comprises a pair of feed wires 840, metal plates 830*a* and 830*b* which are parallel to the feed wires 840 and which are oppositely faced and between which the feed wires 840 are disposed, and a radiation structure 820 to interconnect the feed wire 840 and the metal plates 830*a* and 830*b*.

On one side of the radiation structure 820 is formed the feed conductor 820*a* which can receive an input electric signal transmitted from the feed wire 840 since stubs are formed thereon. As the feed wires 840 have positive (+) and negative (−) poles, the broadband antenna system 800 depicted in FIG. 8A can operate as a dipole antenna. Further, the feed conductor 820*a* is separated from the metal plates 830*a* and 830*b*.

On the opposite face to a plane on which the feed conductor 820*a* is formed is formed a radiating conductor 820*b* connected perpendicularly to the metal plates 830*a* and 830*b*, and coupled to the signal providing means to thereby generate electromagnetic waves.

In FIGS. 8A and 8B, the feed wires 840 and the feed conductor 820*a* are formed so as to be interconnected on the same plane.

Figure 9:
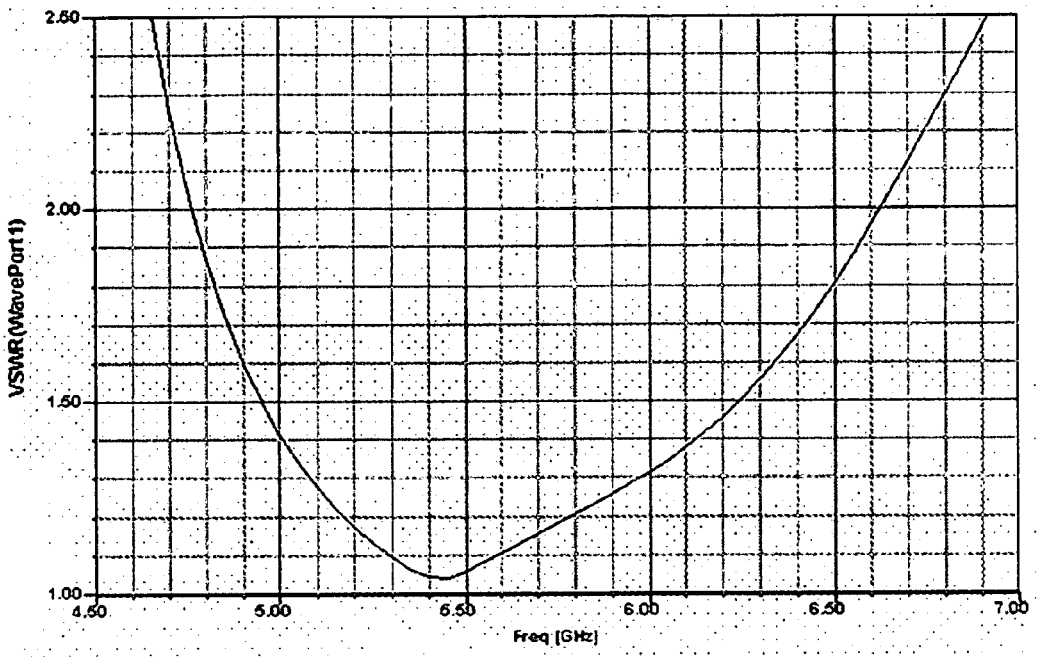
FIG. 9 illustrates simulation results of matching characteristics of a broadband antenna system according to the present invention.

FIG. 9 illustrates a simulation result representing matching characteristics of a broadband antenna system according to the present invention, wherein the voltage standing wave ratio (VSWR) is plotted against frequency. Referring to the shown graph, where VSWR=2, a bandwidth in the range of about 4.76 GHz to about 6.6 GHz can be obtained.

Figure 10:
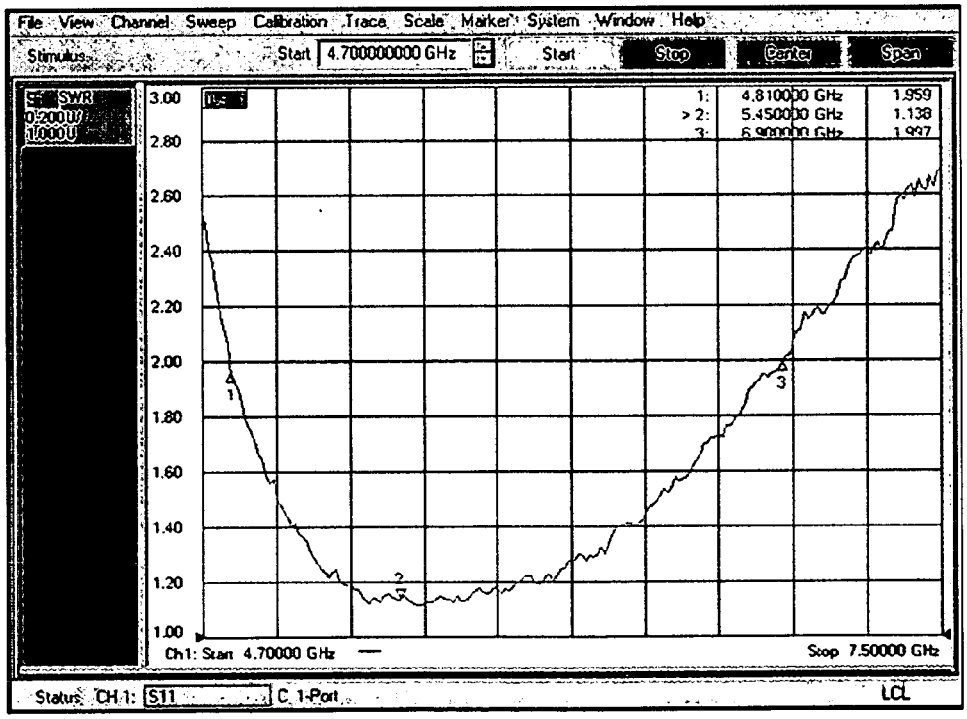
FIG. 10 illustrates measurement results obtained from the Agilent™ network analyzer when a prototype of a broadband antenna system according to the present invention is measured.

FIG. 10 illustrates measurement results obtained from the Agilent™ network analyzer when a prototype of a broadband antenna system according to the present invention is measured. Referring to this, when an S11 parameter is 2, a bandwidth in the range of about 4.8 GHz to about 6.9 GHz is obtained.

The broadband antenna system according to the present invention can be applied to a broadband wireless local area network (WLAN), a multi input multi output (MIMO) system, and a wireless digital television. Further, a broadband antenna system in an array form can be constructed of several broadband antenna systems.

According to the present invention, a small-sized monopole/dipole broadband antenna system is provided which is applicable to a variety of wireless devices requiring broadband communication functionality and compactness.

Although the present invention has been described in connection with exemplary embodiments, it will be apparent to those skilled in the art that various modifications and changes may be made thereto without departing from the scope and spirit of the invention. Therefore, it should be understood that the above exemplary embodiments are not limitative, but illustrative in all aspects.

What is claimed is:

1. A broadband antenna system comprising:

a ground plane;

a metal plate which is parallel to the ground plane, and constitutes a capacitance load against the ground plane; and a radiation structure which is connected perpendicularly to the ground plane and the metal plate, the radiation structure comprising:

a feed conductor which supplies an electric signal;

a short-circuit stub which transfers the supplied electric signal to the ground plane;

a conducting bridge which interconnects the feed conductor and the short-circuit stub, and which is separated and electrically isolated from the metal plate; and a first radiating conductor which is connected to the ground plane and the metal plate, and coupled to the supplied electric signal source to thereby radiate electromagnetic waves, wherein the feed conductor, the short-circuit stub and the conducting bridge are formed on a first plane of the radiation structure, and the first radiating conductor is formed on a second plane of the radiation structures;

wherein the first plane is parallel to the second plane, and the first plane does not intersect the second plane.

2. The broadband antenna system according to claim 1, further comprising a second radiating conductor which is connected perpendicularly to the metal plate and the ground plane and coupled to the supplied electric signal, to thereby radiate electromagnetic waves, wherein the second radiating conductor is formed on a third plane of the radiation structure, and the second plane and the third plane are formed on opposite sides of the first plane.

3. The broadband antenna system according to claim 1, wherein the radiation structure is a rectangular parallelepiped, and the first and second planes are opposite sides of the rectangular parallelepiped.

4. The broadband antenna system according to claim 2, wherein the radiation structure comprises first and second rectangular parallelepipeds which are coupled together, the second plane is an outer side of the first rectangular parallelepiped, the third plane is an outer side of the second rectangular parallelepiped, and the first plane is a layer where the first and second rectangular parallelepipeds are coupled together.

5. A broadband antenna system comprising:

a ground plane;

a metal plate which is parallel to the ground plane, and constitutes a capacitance load against the ground plane; and a radiation structure which connects the ground plane and the metal plate, wherein the radiation structure compromises:

a feed conductor which supplies an electric signal;

two short-circuit stubs, each of which transfers the supplied electric signal to the ground plane;

a conducting bridge which connects the feed conductor and the two short-circuit stub, and which is separated and electrically isolated from the metal plate; and two radiating conductors, each of which is connected perpendicularly to the metal plate and the ground plane and coupled to the supplied electric signal, to thereby radiate electromagnetic waves;

wherein the two short-circuit stubs are disposed on opposite sides of the feed conductor, and the two radiating conductors are disposed on opposite sides of the feed conductor.

6. The broadband antenna system according to claim 5, wherein the feed conductor corresponds to an internal conductor of a coaxial cable, and the short-circuit stubs and the radiating conductors correspond to an external conductor of the coaxial cable.

7. The broadband antenna system according to claim 5, wherein the feed conductor, the short-circuit stubs and the radiating conductors are formed of conducting wires.

* * * * *